US005808223A

United States Patent [19]

Kurakake et al.

[11] Patent Number: 5,808,223

[45] Date of Patent: Sep. 15, 1998

[54] MUSIC DATA PROCESSING SYSTEM WITH CONCURRENT REPRODUCTION OF PERFORMANCE DATA AND TEXT DATA

[75] Inventors: Yasushi Kurakake; Takuya Nakata, both of Hamamatsu, Japan

[73] Assignee: Yamaha Corporation, Japan

[21] Appl. No.: 719,319

[22] Filed: Sep. 25, 1996

[30] Foreign Application Priority Data

Sep. 29, 1995 [JP] Japan ..... 7-253683
Oct. 25, 1995 [JP] Japan ..... 7-278117

[51] Int. Cl.[6] ..... A63H 5/00; G04B 13/00; G10H 7/00

[52] U.S. Cl. ..... 84/609; 434/307 A

[58] Field of Search ..... 84/600, 609, 634, 84/618, 656; 434/307 A; 395/603, 606

[56] References Cited

U.S. PATENT DOCUMENTS 5,046,004 9/1991 Tsumura et al. ..... 84/645 X
5,194,682 3/1993 Okamura et al. ..... 84/625
5,233,438 8/1993 Funahashi et al. .
5,250,747 10/1993 Tsumura ..... 84/645
5,294,745 3/1994 Yamauchi et al. ..... 84/645 X
5,402,339 3/1995 Nakashima et al. ..... 364/419.19
5,416,526 5/1995 Yamamoto .
5,453,570 9/1995 Umeda et al. ..... 84/636
5,574,239 11/1996 Kang et al. ..... 84/610
5,589,947 12/1996 Sato et al. ..... 84/645 X
5,635,657 6/1997 Lee et al. ..... 84/610

FOREIGN PATENT DOCUMENTS 0 484 043 5/1992 European Pat. Off. .
0 598 597 5/1994 European Pat. Off. .
2 278 227 11/1994 United Kingdom .

*Primary Examiner*—William M. Shoop, Jr.
*Assistant Examiner*—Jeffrey W. Donels
*Attorney, Agent, or Firm*—Graham & James LLP

[57] ABSTRACT

A music data processing system having: a storage unit for storing performance data and text data or auxiliary data in a first storage format or in a second storage format; a first data search unit for searching the text data or auxiliary data stored in the first storage unit; a second data search unit for searching the text data or auxiliary data stored in the second storage unit; and a processing unit for processing text data or auxiliary data if the text data or auxiliary data of the first storage format can be searched by said first data search unit, and if the text data or auxiliary data of the first storage format cannot be searched, processing text data or auxiliary data if the text data or auxiliary data of the second storage format can be searched by the second data search unit.

27 Claims, 15 Drawing Sheets

MUSIC DATA PROCESSING SYSTEM WITH CONCURRENT REPRODUCTION OF PERFORMANCE DATA AND TEXT DATA

BACKGROUND OF THE INVENTION a) Field of the Invention

The present invention relates to a music data processing system in which a performance data is processed at the same time when its text data or auxiliary data is processed.

b) Description of the Related Art

Karaoke sing-along machines and other machines use stored automatic performance data and text data. During playing karaoke music, while automatic performance data is reproduced, its text data is displayed on a display screen. A plurality type of data formats are used for storing automatic performance data and text data. It has been difficult for a single music data processing system to deal with a plurality type of data formats.

In one data format, both automatic performance data and text data are stored in the same storage medium in a mixed state in order to synchronize reproduction of automatic performance data with display of text data. With this format, at the same time when the performance data is read from the storage medium and reproduced, the text data is also read and displayed. Therefore, if the amount of text data is large, a delay in reproducing (sound-generating) the performance data may occur.

There is a large amount of performance data not usable by karaoke sing-along machines such as automatic performance data for electronic musical instruments. There is a need for using such performance data with karaoke sing-along machines. It is not easy, however, to use such performance data with conventional karaoke sing-along machines.

There is also a need for adding text data or auxiliary data to such performance data. Auxiliary data is data used for searching performance data, such as a music composer name, a music text author name, and a singer name. It is not easy, however, to edit performance data to add text data or auxiliary data thereto.

SUMMARY OF THE INVENTION

An object of the present invention is to provide a music data processing system capable of processing text data or auxiliary data of a plurality type of data formats.

Another object of the invention is to provide a music data processing system capable of eliminating a performance delay to be caused by text data.

Still another object of the invention is to provide a music data processing system capable of easily adding text data or auxiliary data to performance data without text data or auxiliary data.

According to one aspect of the present invention, there is provided a music data processing system comprising: input means for externally inputting data having a format containing both performance data and text data in a mixed state; a memory having a performance data storage area for storing the performance data and a text data storage area for storing the text data; writing means for writing the data input from the inputting means separately into the performance data storage area and into the text data storage area; text data reproducing means for reading and reproducing the text data stored in the text data storage area; and performance data reproducing means for reading and reproducing the performance data stored in the performance data storage area, with a priority over the text data reproducing means.

Even if data containing both performance data and text data in a mixed state is externally supplied, the data is separated into performance data and text data and the performance data is processed with a priority over the text data. Accordingly, a delay in reproducing the performance data can be prevented which is otherwise generated depending on the amount of the text data.

According to another aspect of the present invention, there is provided a music data processing system comprising: storage means for storing performance data with a file name identifying the performance data and storing text data corresponding to the performance data with an attribute name relatable to the file name; designating means for designating a file name of the performance data to be reproduced; performance data reproducing means for reading performance data having the file name designated by the designating means and reproducing the performance data; search means for searching text data with an attribute name relatable to the file name of the performance data designated by the designating means; and text data reproducing means for reading the searched text data having the attribute name relatable to the file name designated by the designating means.

Even if performance data and text data are stored in different files, an operator can reproduce the performance data and corresponding text data only by designating the file name of the performance data.

According to a further aspect of the present invention, there is provided a music data processing system comprising: storage means for storing performance data and text data in a first storage format or in a second storage format; first text data search means for searching the text data stored in the first storage format; second text data search means for searching the text data stored in the second storage format; and reproducing means for reproducing text data and performance data if the text data of the first storage format can be searched by the first text data search means, and if the text data of the first storage format cannot be searched, reproducing text data and performance data if the text data of the second storage format can be searched by the second text data search means.

The first and second data search means search text data from storage means storing performance data and text data in at least two different storage formats. Accordingly, even if the performance data and text data are stored in any one of storage formats, they can be reproduced.

According to a still further aspect of the present invention, there is provided a music data processing system comprising: storage means for storing performance data with a file name identifying the performance data and storing auxiliary data corresponding to the performance data with an attribute name relatable to the file name; designating means for designating a file name of the performance data to be reproduced; performance data reproducing means for reading performance data having the file name designated by the designating means and reproducing the performance data; search means for searching auxiliary data with an attribute name relatable to the file name of the performance data designated by the designating means; and auxiliary data processing means for reading the searched auxiliary data having the attribute name relatable to the file name designated by the designating means.

Even if performance data and auxiliary data are stored in different files, an operator can select and process auxiliary data corresponding to the performance data only by designating the file name of the performance data.

According to another aspect of the present invention, there is provided a music data processing system comprising: storage means for storing performance data and auxiliary data in a first storage format or in a second storage format; first auxiliary data search means for searching the auxiliary data stored in the first storage format; second auxiliary data search means for searching the auxiliary data stored in the second storage format; and auxiliary data processing means for processing auxiliary data if the auxiliary data of the first storage format can be searched by the first auxiliary data search means, and if the auxiliary data of the first storage format cannot be searched, processing auxiliary data if the auxiliary data of the second storage format can be searched by the second auxiliary data search means.

The first and second auxiliary data search means search auxiliary data from storage means storing performance data and auxiliary data in at least two different storage formats. Accordingly, even if the performance data and auxiliary data are stored in any one of storage formats, they can be processed reliably.

BRIEF DESCRIPTION OF THE DRAWINGS

FIG. 3A shows the format of a sequential file, and FIG. 3B shows the data structure of a track chunk.

FIG. 4A shows the format of a sequential file, FIG. 4B shows the data structure of a track chunk, and FIG. 4C shows the data structure of a text chunk.

FIG. 5A shows the formats of a sequential file and a text file, FIG. 5B shows the data structure of a track chunk, and FIG. 5C shows the data structure of a text file.

FIG. 6A shows the data format in a performance event area in RAM, and FIG. 6B shows the data format in a text event area in RAM.

FIG. 7A shows an example of text event data of the first to third data formats, and FIG. 7B shows an example of row event data stored in the text event area.

FIG. 12A shows the format of a sequential file, and FIG. 12B shows the data structure of a track chunk.

FIG. 13A shows the format of a sequential file, FIG. 13B shows the data structure of a track chunk, and FIG. 13C shows the data structure of a text chunk.

FIG. 14A shows the formats of a sequential file, a text file, and an auxiliary file, FIG. 14B shows the data structure of a track chunk, and FIG. 14C shows the data structure of a text file.

DETAILED DESCRIPTION OF THE PREFERRED EMBODIMENTS

Figure 1:
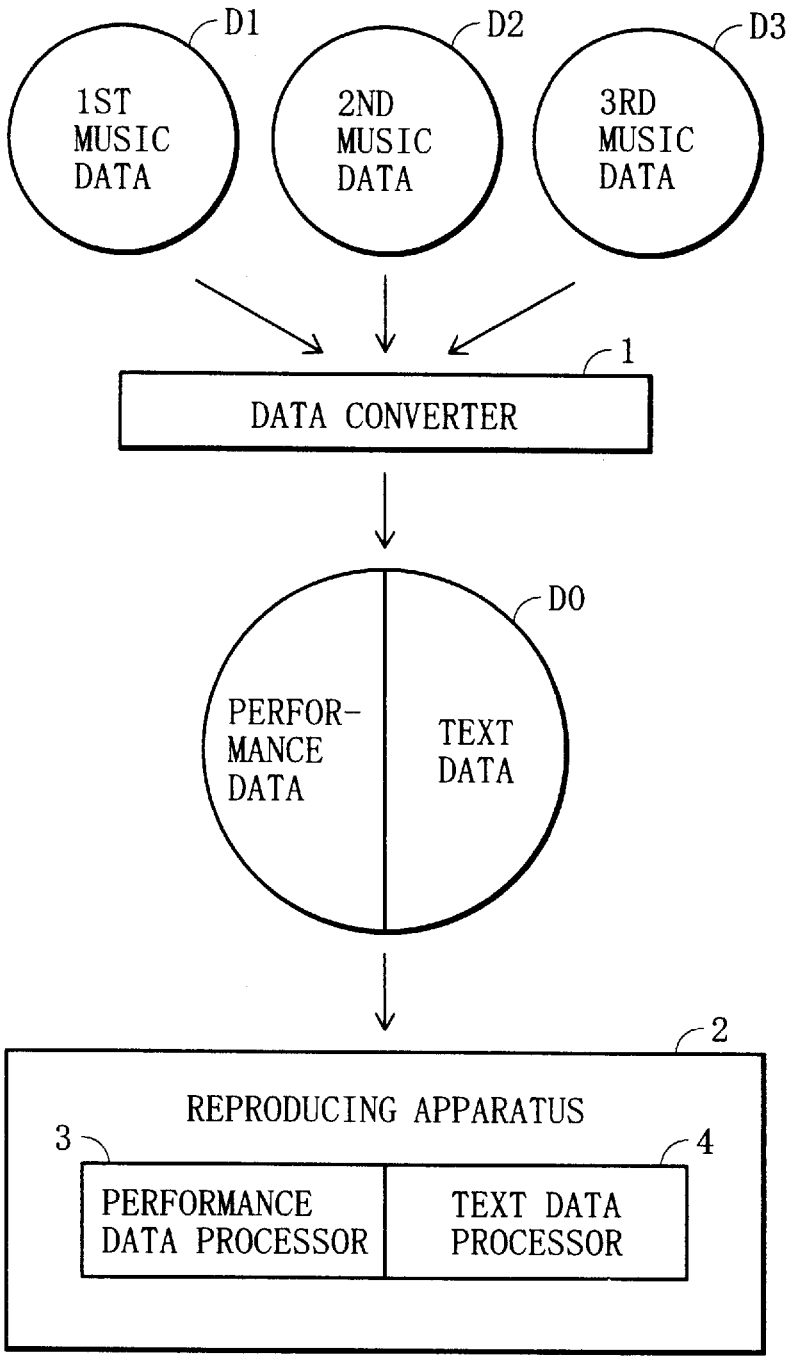
FIG. 1 is a diagram illustrating the function of a music data processing system according to an embodiment of the invention.

FIG. 1 is a diagram illustrating the function of a music data processing system according to the embodiment of the invention.

First music data D1, second music data D2, and third music data D3 each include performance data and text data. The data formats of the first to third data D1 to D3 are different. For example, one music data contains performance data and text data in a mixed state, and another music data contains perfectly separated performance data and text data.

A data converter 1 converts any one of the input music data D1 to D3 into music data D0 of the standard data format. The music data D0 of the standard data format has performance data and text data separated from each other. The different formats of the music data D1 to D3 are converted into the standard data format of music data D0.

A reproducing apparatus 2 has a performance data processor 3 and a text data processor 4 and reproduces the received music data D0. The performance data processor 3 reproduces the performance data and generates sounds. The text data processor 4 displays text data on a display.

Since the performance data and text data are separately reproduced, a delay of the performance data dependent upon the amount of the text data hardly occurs. The performance data and text data are reproduced at suitable timings by using time data the details of which will be later given.

The music data processing system of this embodiment can reproduce any one of the input music data D1 to D3 each having a different format. Even if music data of a format which contains only performance data, such as automatic performance data of an electronic musical instrument, can be added with text data the details of which will be later given.

Figure 2:
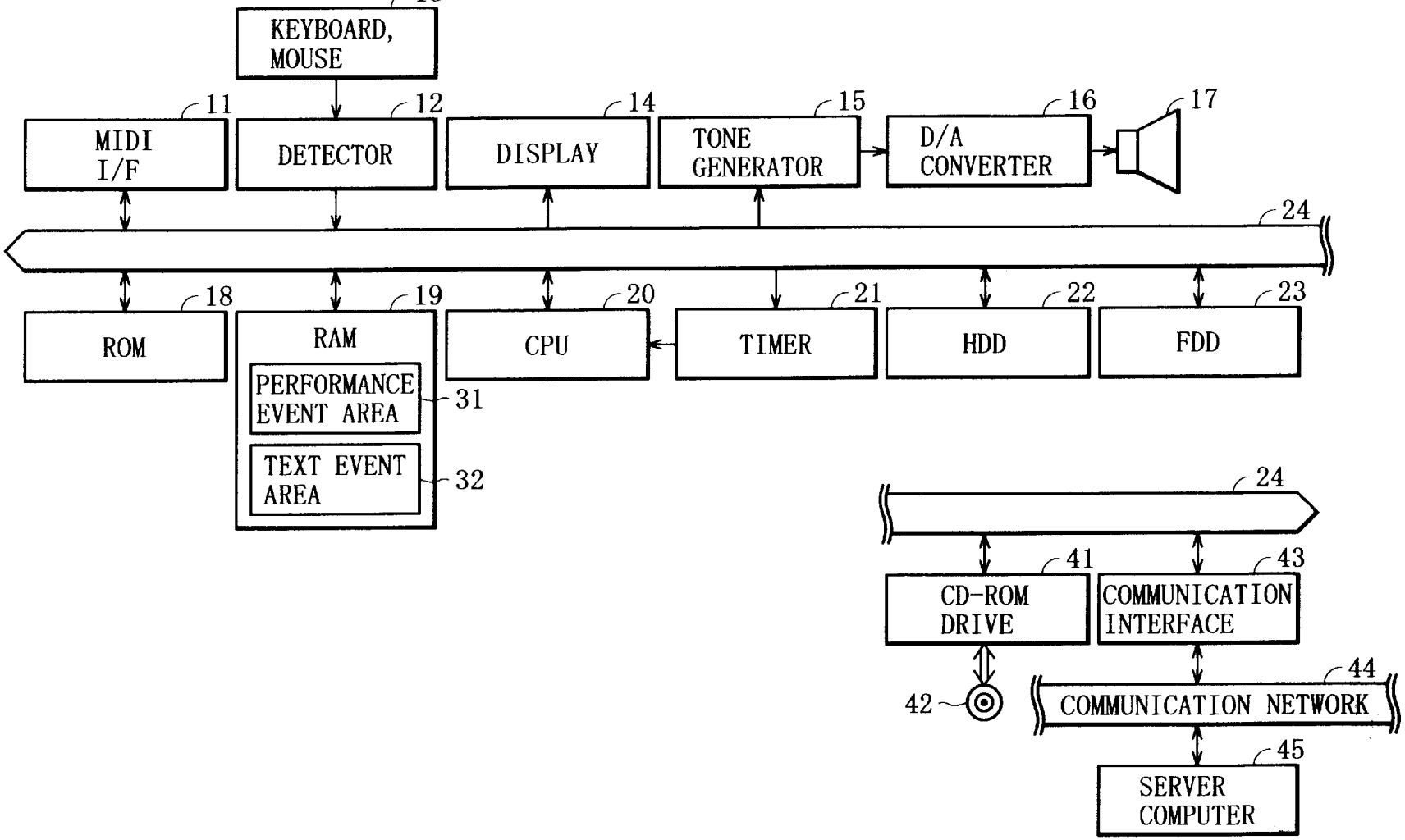
FIG. 2 is a block diagram showing the hardware structure of the music data processing system of the embodiment.

FIG. 2 is a block diagram showing the hardware structure of the music data processing system of the embodiment.

A CPU 20 is connected via a bus 24 to a ROM 18, a RAM 19, a timer 21, a MIDI interface 11, a detector 12, a display 14, a tone generator 15, a hard disk drive (HDD) 22, a floppy disk drive (FDD) 23, a CD-ROM (compact disk read-only memory) drive 41, and a communication interface 43.

RAM 19 has a performance event area 31 and a text event area 32. The performance event area 31 is an area for storing performance event data of the converted standard format, and the text event area 32 is an area for storing text event data of the converted standard format.

RAM 19 has also working areas for CPU 20, such as registers and buffers. ROM 18 stores computer programs and various parameters. CPU 20 executes various processes by using the computer programs stored in ROM 18.

CPU 20 receives music data from the hard disk drive 22, floppy disk drive 23, CD-ROM drive 41, MIDI interface 11, or communication interface 43, and converts it into music data of the standard format. The performance data of the music data is written in the performance event area 31, and the text data thereof is written in the text event area 32.

The timer 21 supplies CPU 20 with timer interrupt signals at a predetermined time interval. Upon reception of a timer interrupt signal, CPU 20 starts executing a predetermined interrupt process.

The floppy disk drive 23 can write and read data to and from a removable floppy disk. As a floppy disk which stores music data is loaded in the floppy disk drive 23, CPU 20 can read the music data.

The hard disk drive 22 is a large capacity storage which can store a large amount of music data. CPU 20 can transfer music data between the floppy disk drive 23 and hard disk drive 22, and can read music data from the hard disk drive 22.

The MIDI interface 11 transfers MIDI data such as music data to and from an external equipment.

The detector 12 is connected to an input device 13 such as a keyboard and a mouse. CPU 20 detects the state of switches or the like of the input device 13 via the detector 12. An operator can designate various instructions by operating upon the input device 13. For example, music data to be reproduced can be designated. The input device 13 has also a reproduction switch for instruction to reproduce music data.

The display 14 displays text data stored in the text event area 32 of RAM 19, and can display the type of music data stored in the hard disk drive 22.

The tone generator 15 generates a tone signal upon reception of performance data stored in the performance event area 31 of RAM 19. For generating a tone signal, the tone generator 15 may use a waveform memory scheme, an FM scheme, a physical model scheme, a harmonics synthesis scheme, a formant synthesis scheme, an analog synthesis scheme including VCO (voltage controlled oscillator), VCF (voltage controlled filter), and VCA (voltage controlled amplifier), or other schemes.

A D/A converter 16 receives a digital tone signal from the tone generator 15 and converts it into an analog tone signal.

A sound system 17 has an amplifier and a speaker, receives an analog tone signal from the D/A converter 16 to amplify it by the amplifier and generate sounds from the speaker.

HDD (hard disk drive) 22 is a storage unit for storing various data such as computer programs, music data (automatic performance data), and the like. If computer programs are not stored in ROM 18, computer programs are stored in a hard disk of HDD 22 and written in RAM 19 to run CPU 20. In this manner, addition, version-up, and the like of computer programs become easy.

The CD-ROM drive 41 reads the computer programs and various data stored in a compact disk 42. The computer programs and various data are stored in a hard disk of HDD 22, facilitating new installation and version-up of computer programs. Other drives may also be installed to use other external storage media such as a magnetooptical disk.

The communication interface 43 is connected to a communication network 44 such as a LAN (local area network), Internet, and telephone lines, and via the communication network 44 to a server computer 45. If computer programs and various data are not stored in HDD 22, they are down loaded from the server computer 45. The music data processing system of this embodiment as a client transmits a command requesting for down-loading computer programs and data to the server computer 45 via the communication interface 43 and communication network 44. Upon reception of this command, the server computer 45 supplies the requested computer programs and data to the music data processing system via the communication network 44 and communication interface 43, and the music data processing system stores the received programs and data in HDD 22 to complete the down-load.

The embodiment may be practiced by commercial personal computers or the like by loading therein the computer programs and various data of this embodiment. The computer programs and various data of the embodiment may be supplied to users in the form of storage media such as a compact disk and a floppy disk readable by a personal computer. If a personal computer is used connected to a communication network such as LAN, Internet, and telephone lines, the computer programs and various data may be supplied thereto via the communication network.

Application of such configurations of the embodiment system is not limited only to a karaoke sing-along machine but also to an electronic musical instrument and a combination of a personal computer and application software.

The tone generator 15 may be formed by dedicated hardware, by a DSP (digital signal processor) and microprograms, by a CPU and software, by a plurality of time divisional sound generating channels, or by a plurality of sound generating channels each constituted by a separate circuit.

HDD 22, floppy disk drive 23, CD-ROM drive 41, MIDI interface 11, or communication interface 43 supplies music data of a variety type of formats to CPU 20.

Next, three examples of the format of music data of a standard MIDI file type will be described with referent to FIGS. 3A to 5C.

Figure 3A:
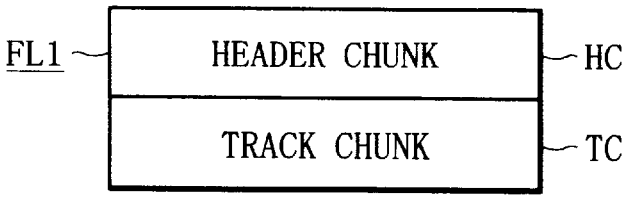
FIGS. 3A and 3B show a first data format.
Figure 3B:
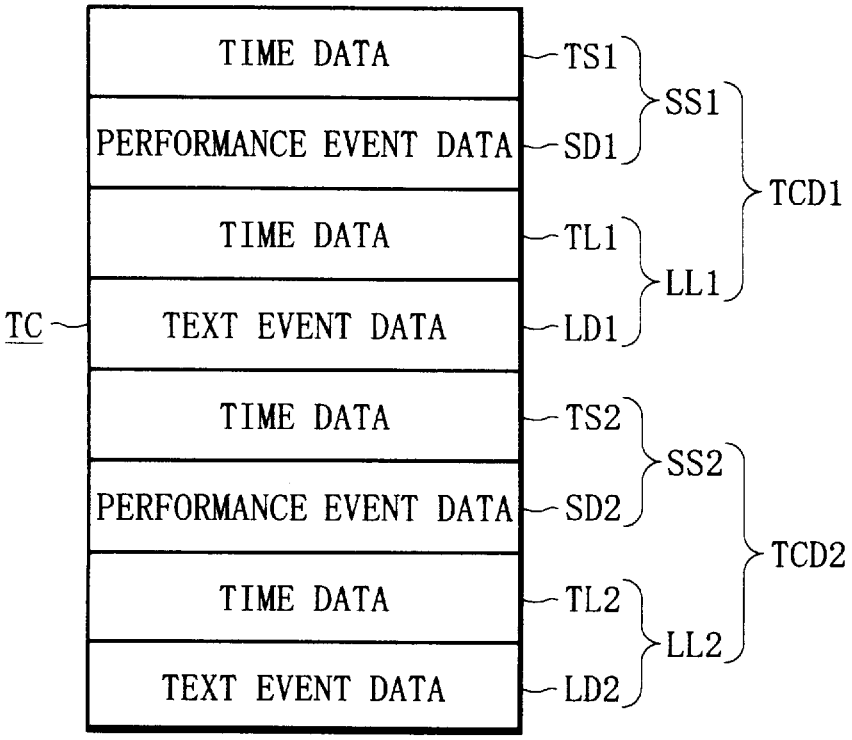

FIGS. 3A and 3B show a first data format. FIG. 3A shows the format of a sequence file FL1. One set of music data is represented by one sequence file FL1. The sequence file FL1 is stored in HDD 22 or the like. The sequence file FL1 has a header chunk HC and a trunk chunk TC. The header chunk HC contains information (identification code of the first, second, or third data format) and information of time resolution of data. The structure of the track chunk TC will be described.

FIG. 3B shows the data structure of the track chunk TC. The track chunk TC has a plurality set of trunk chunk data TCD1, TCD2, . . . Each trunk chunk TCD1, TCD2 has the same data structure. For example, the trunk chunk TCD1 has performance data SS1 and text data LL1.

The performance data SS1 has time data TS1 and performance event data SD1. The performance event data SD1 is used substantially for generating music sounds. Time data TS1 indicates a time duration from the performance start to the first performance event data SD1. Time data TS2 indicates a time duration between the performance event data SD1 and next performance event data SD2.

The text data LL1 has time data TL1 and text event data LD1. The text event data LD1 is used substantially for displaying texts. Time data TL1 indicates a time duration from the performance start to the first text event data LD1. Time data TL2 indicates a time duration between the text event data LD1 and next text event data LD2.

Although not shown, a program name, a composer name, and the like may be included in the trunk chunk TC.

Figure 4A:
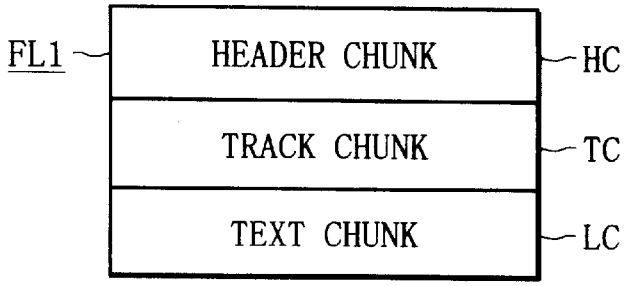
FIGS. 4A to 4C show a second data format.
Figure 4B:
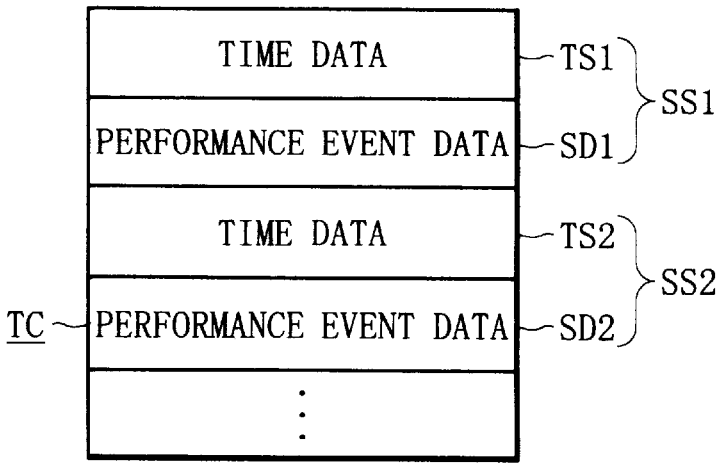
Figure 4C:
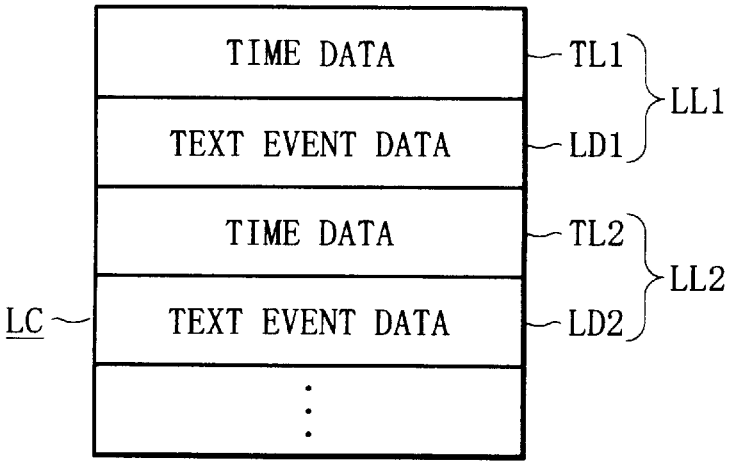

FIGS. 4A to 4C show a second data format.

FIG. 4A shows the format of a sequence file FL1. One set of music data is represented by one sequence file FL1. The sequence file FL1 has a header chunk HC, a trunk chunk TC, and a text chunk LC. The header chunk HC has the same structure as the header chunk of the first data format (FIG. 3A). The structures of the track chunk TC and text chunk LC will be described.

FIG. 4B shows the data structure of the track chunk TC. The track chunk TC has a plurality set of performance data SS1, SS2, . . . Each performance data SS1, SS2 has the same data structure. The performance data SS1 has the structure same as that of the performance data of the first data format (FIG. 3B), and has time data TS1 and performance event data SD1.

FIG. 4C shows the data structure of the text chunk LC. The text chunk LC has a plurality set of text data LL1, LL2, . . . Each text data LL1, LL2 has the same data structure. The text data LL1 has the structure same as that of the text data of the first data format (FIG. 3B), and has time data TL1 and text event data LD1.

Figure 5A:
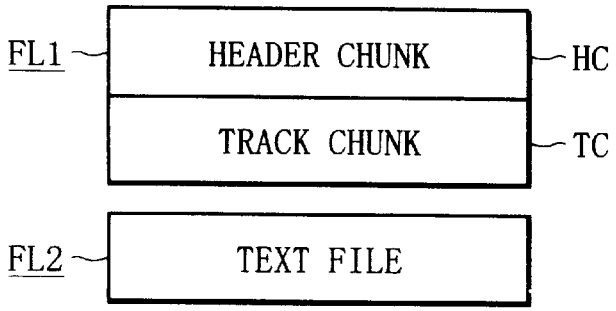
FIGS. 5A to 5C show a third data format.
Figure 5B:
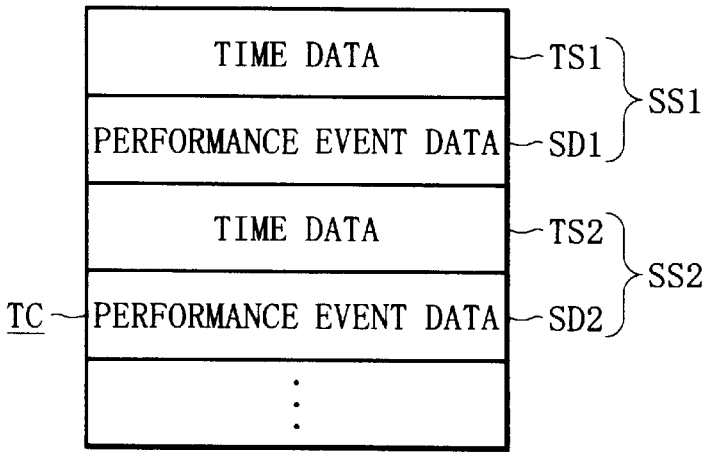
Figure 5C:
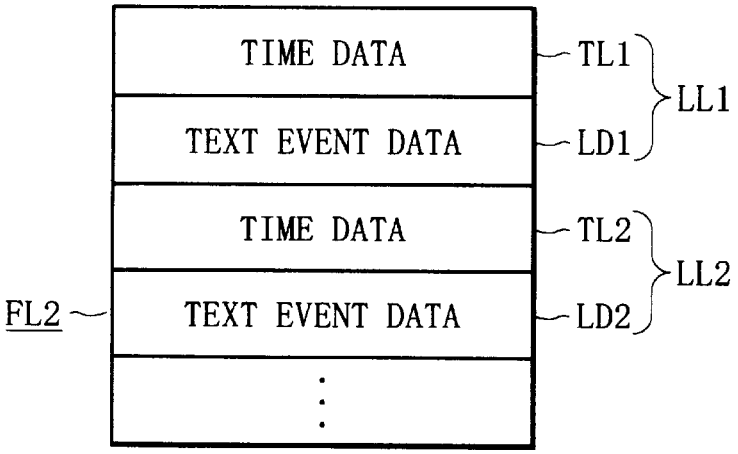

FIGS. 5A to 5C show a third data format.

FIG. 5A shows the formats of a sequence file FL1 and a text file FL2. One set of music data is represented by one sequence file FL1 and one text file FL2, and stored in HDD or the like.

The sequence file FL1 may be an automatic performance data of a conventional electronic musical instrument. The performance file FL2 is a newly formed file in order to use the file FL1 of the electronic musical instrument, for example, with a karaoke sing-along machine. By newly forming only the performance file FL2, the files FL1 and FL2 for a karaoke sing-along machine can be configured.

The sequence file FL1 has a header chunk HC and a trunk chunk TC. The header chunk HC has the same structure as the header chunk of the first or second data format (FIG. 3A, 4A).

FIG. 5B shows the data structure of the track chunk TC. The track chunk TC has the same structure as the trunk chunk of the second format (FIG. 4B) and has a plurality set of performance data SS1, SS2, . . . The performance data SS1 has time data TS1 and performance event data SD1.

Needless to say, in any one of the first to third data formats, the performance data and text data are preferably generated so as to coincide the note timing of performance data with the text timing of text data.

FIG. 5C shows the data structure of the text file FL2. The text file FL2 has the same structure as the performance chunk of the second format (FIG. 4C), and has a plurality set of text data LL1, LL2, . . . The text data LL1 has time data TL1 and performance event data LD1.

Referring back to FIG. 2, CPU 20 converts performance data of each data format described above into performance data of the standard format which is written in the performance event area 31 and text event area 32 of RAM 19.

Next, the formats of data written in the performance event area 31 and text event area 32 will be described.

Figure 6A:
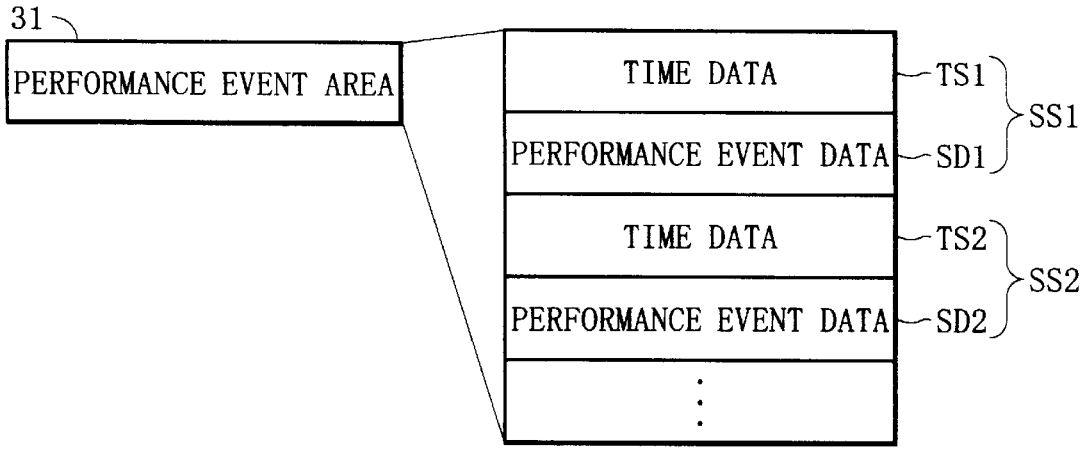
FIGS. 6A and 6B show a standard data format.
Figure 6B:
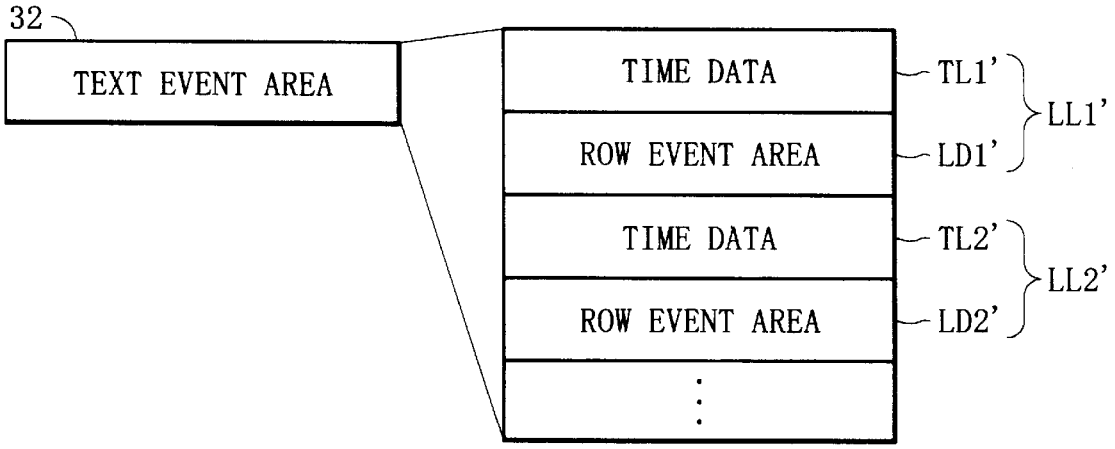

FIGS. 6A and 6B show the standard data format. The music data is separated into performance data and text data which are respectively stored in the performance event area 31 and text event area 32.

FIG. 6A shows the data format of data in the performance event area 31 of RAM 19. A plurality set of performance data SS1, SS2, . . . are stored in the performance event area 31. Each performance data SS1, SS2 has the same data structure. For example, the performance data SS1 has time data TS1 and performance event data SD1 similar to the data structure described above.

FIG. 6B shows the data format of data in the text event area 32 of RAM 19. A plurality set of text data LL1', LL2', . . . are stored in the text event area 32. Each text data LL1', LL2' has the same data structure. For example, the text data LL1' has time data TL1' and row event data LD1' different from the data structure described above.

The row event data LD1' holds a lump of one row of text data. For example, the first to third data formats before conversion into the standard format describes text data in the unit of syllable. Therefore, in order to display texts one row after another on the display 14 during playing music, a string of characters is required to be converted into rows. The time data TL1' of one text row corresponds to time data of a sum of time data at respective syllables. This will be detailed by using a particular example.

Figure 7A:
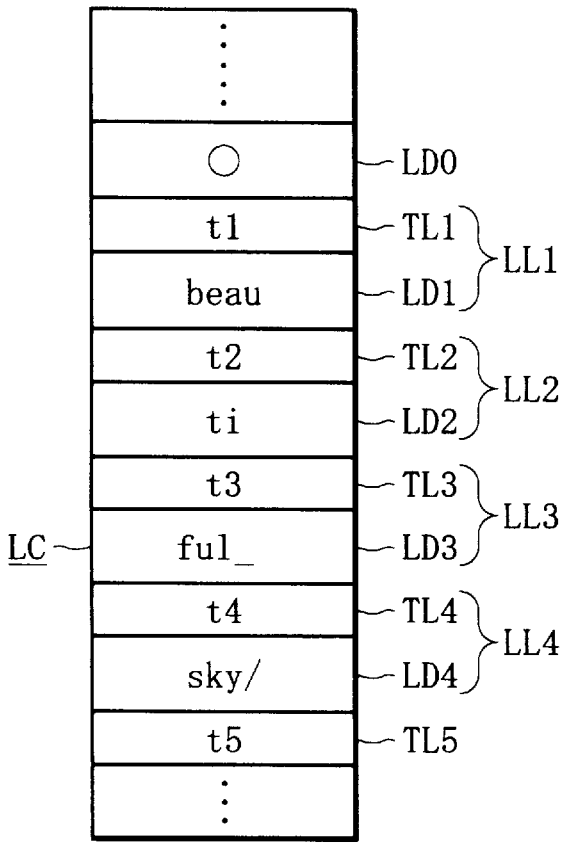
FIGS. 7A and 7B show an example of conversion from text event data to row event data.
Figure 7B:
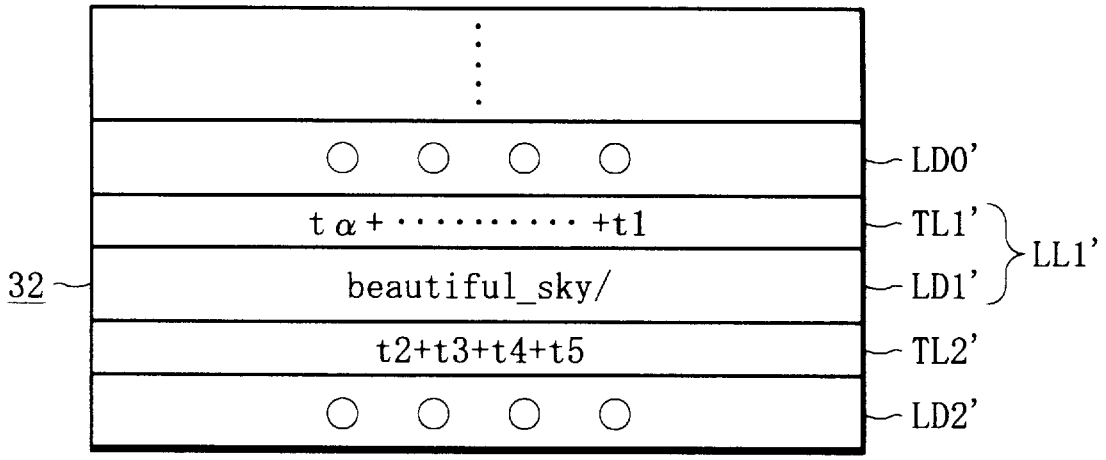

FIGS. 7A and 7B show an example of conversion of text event data into row event data.

FIG. 7A shows an example of text event data of the first to third data formats. The text chunk LC has four sets of text data LL1 to LL4. Four sets of time data TL1 to TL4 of the text data are t1, t2, t3, and t4, and the four sets of the text event data LD1 to LD4 are "beau", "ti", "ful_", and "sky/". "_" represents a space, and "/" represents a return (new row). Each text data LL corresponds to one note, and is a unit partitioned by, for example, syllable. The text data LL may contain two or more syllables, or one word.

FIG. 7B shows an example of row event data stored in the text event area 32. Text data LL1' is stored in the text event area 32. Time data TL1' of the text data LL1' is a sum (td+, . . . , +t1) of time data from the first syllable of the one preceding row event data LD0' to the first syllable of the row event data LD1'. The row event data LD1' is "beautiful_ sky/". Time data TL2' of the next row event data LD2' is "t2+t3+t4+t5". The row event data LD1' is the data obtained by re-configuring the text event data shown in FIG. 7A, and characters up to the return symbol constitute one set of row data. Text data is displayed on the display in the unit of row.

Figure 8:
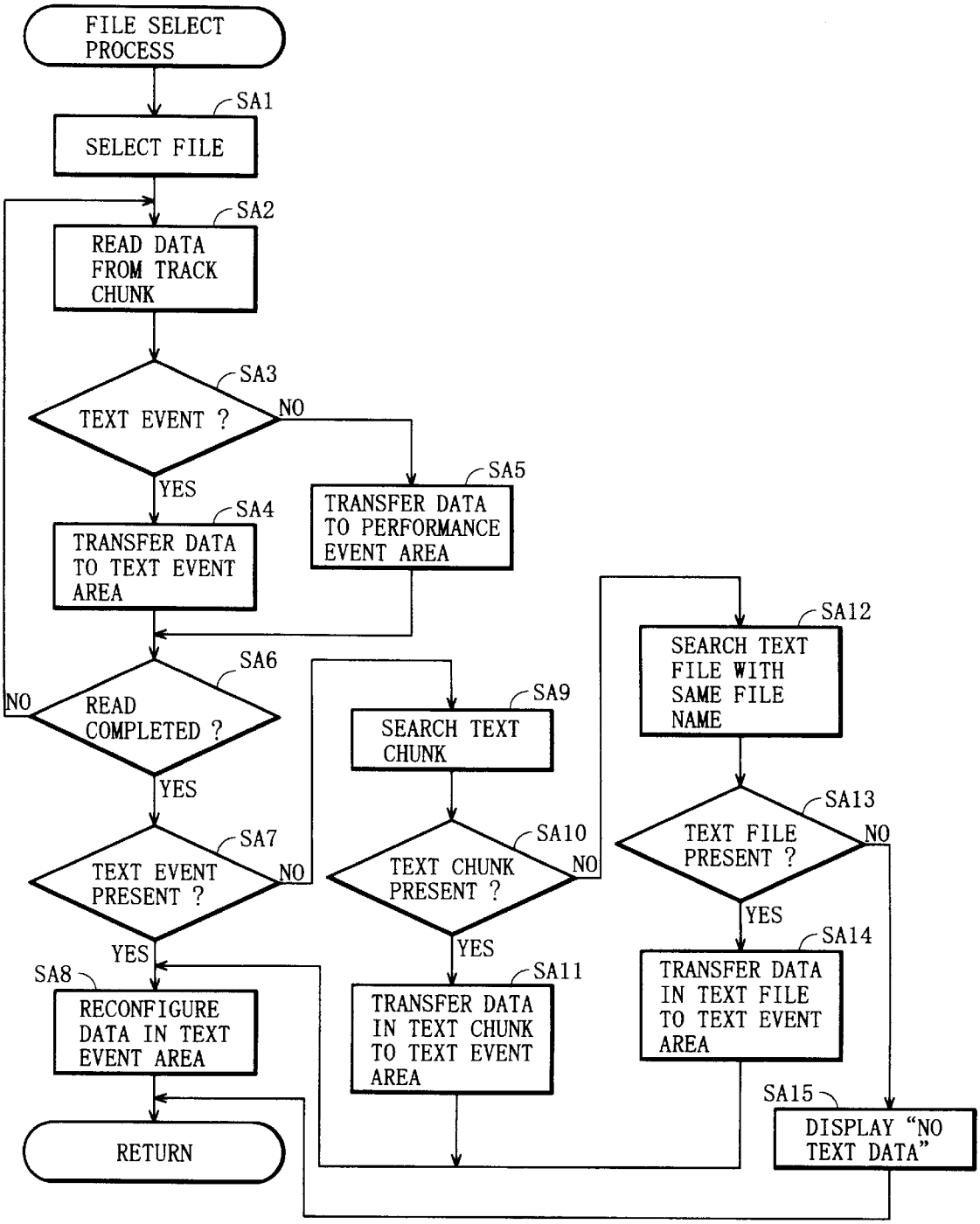
FIG. 8 is a flow chart illustrating a file selection process to be executed by CPU.

FIG. 8 is a flow chart illustrating a file selection process to be executed by CPU.

At step SA1, a file is designated. Sequence file names of music data stored in HDD 22 or the like are displayed on the display 14 shown in FIG. 2. An operator selects a desired file by using the input device 13 such as a keyboard and a mouse. The format of the file selected by the operator may be any one of the first to third data formats.

At step SA2, data of the track chunk of the selected file is read. An identification code representative of a start of the track chunk is contained in the file. The position of the track chunk can be identified by this identification code. Data read from the track chunk is a combination of time data and text event data or a combination of time data and performance event data.

At step SA3, it is checked whether the read data is text data or performance data. If text data, the flow advances to step SA4 whereat the read data is transferred to the text event area 32 of RAM, and thereafter the flow advances to step SA6.

If the read data is performance event data, the flow advances to step SA5 whereat the read data is transferred to the performance event area 31 of RAM, and thereafter the flow advances to step SA6. If time data is read, it is transferred to both the areas 31 and 32 at steps SA4 and SA5. As in the case of the first data format (FIGS. 3A and 3B), if both the performance data and text data are in the same chunk in a mixed state, the time data for the performance data and text data is also in the same chunk in a mixed state and is transferred to the both areas 31 ad 32. The same time data is shared both by the performance data and text data.

It is checked at step SA6 whether or not all data in the track chunk has been read. If not, the flow returns to step SA2 to repeat the same processes as above for the next data in the track chunk. If all data has been read, the flow advances to step SA7.

It is checked at step SA7 whether or not the data read from the track chunk contains text event data. If contained, it means the first data format (FIGS. 3A and 3B) and the flow advances to step SA8. In this case, both the text data and performance data have been transferred to the event areas 31 and 32.

At step SA8, the data in the text event area is re-configured to complete this process. With this re-configuration, text event data is re-configured into row event data.

If it is judged at step SA7 that the data read from the track chunk does not contain text event data, it means either the second or third data format (FIGS. 4A to 4C, FIGS. 5A to 5C) and the flow advances to step SA9 to execute a different process for text event data.

At step SA9, a text chunk is searched from the selected sequence file. An identification code representative of a start of the text chunk is contained in the file. The position of the text chunk can be identified by this identification code.

At step SA10 it is checked whether or not the text chunk has been found. If found, it means the second data format (FIGS. 4A to 4C), and the flow advances to step SA11.

At step SA11, the data read from the text chunk is transferred to the text event area 32 of RAM. At step SA8, the data in the text event area 32 is reconfigured to terminate the process.

If it is judged at step SA10 that no text chunk has been found, it means the third data format (FIGS. 5A to 5C), and the flow advances to step SA12.

At step SA12, a text file having the same file name as the selected sequence file is searched. The third data format has two files, sequence file FL1 and text file FL2, as shown in FIGS. 5A to 5C.

For example, a sequence file has a file name "ABCD-.MID" and a text file has a file name "ABCD.LYR". A file name has a main part such as ABCD and an extension part such as MID or LYR. These two files have the same main part of the file name "ABCD" and different extension parts "MID" and "LYR" of the file names. The extension part of the file name "MID" indicates a sequence file, and "LYR" indicates a text file.

Assuming that the sequence file "ABCD.MID" was selected, a text file "ABCD.LYR" having the same main part of the file name is searched.

At step SA13 it is checked whether or not a text file has been found. If found, the flow advances to step SA14.

At step SA14, the data read from the text file is transferred to the text event area 32 of RAM. At step SA8, the data in the text event area 32 is reconfigured to terminate the process.

If it is judged at step SA13 that no text file has been found, the flow advances to step SA15. At step SA15 a message "No text data" is displayed on the display to terminate the process.

With the above process, event data of the first to third data formats is converted into event data of the standard format and stored in the performance and text event areas 31 and 32.

Figure 9:
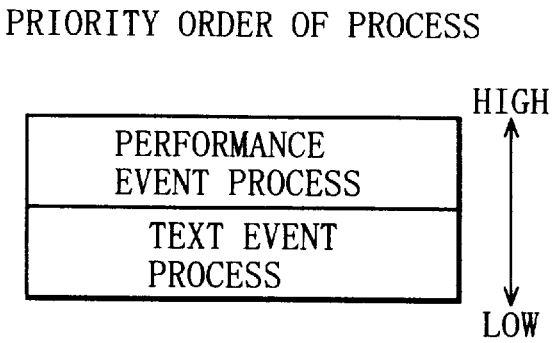
FIG. 9 is a diagram illustrating a priority order of a performance event process and a text event process.

FIG. 9 is a diagram showing the priority degree between a performance event process and a text event process which are executed by the performance event processor 3 and text event processor 4 shown in FIG. 1.

The performance event process and text event process are both an interrupt process. The priority order of the interrupt process is higher for the performance event process than for the text event process.

The performance event process is a process of reproducing performance data. The text event process is a process of displaying text data. Even the amount of text event data is large, a delay in reproducing performance data can be prevented by giving the performance event data with a higher priority order. This priority process becomes possible because the performance data and text data are stored in separate event areas.

A listener is not so much nervous about a small delay in displaying text data, but very sensitive to a delay in reproducing a performance. It is therefore necessary to preferentially avoid a delay in reproducing a performance.

Next, the performance event process and text event process will be described.

Figure 10:
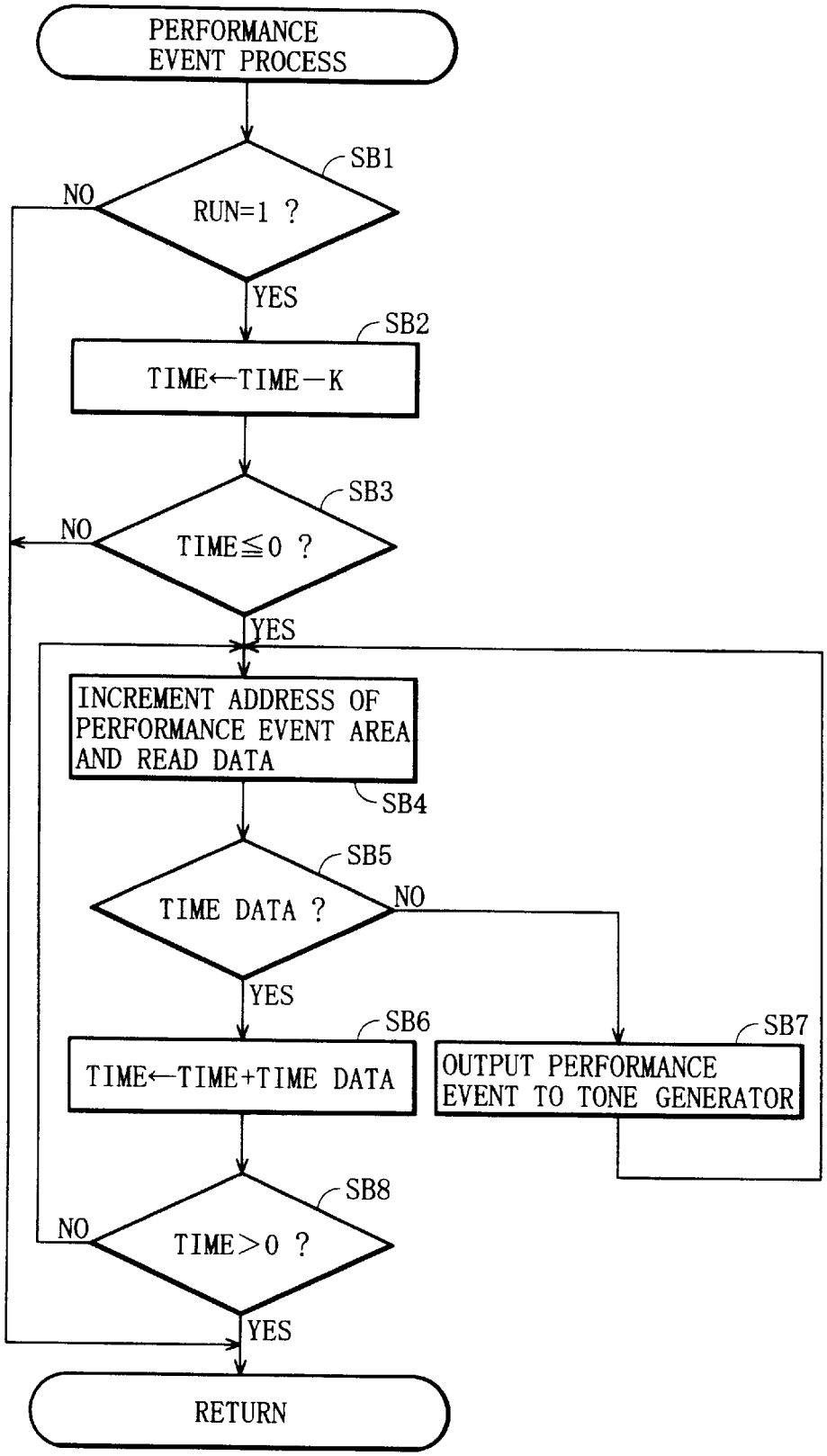
FIG. 10 is a flow chart illustrating a performance event process.

FIG. 10 is a flow chart illustrating the performance event process which is an interrupt process with an interrupt interval of, for example, 10 ms.

At step SB1 it is checked whether or not a reproduction flag RUN is "1". The reproduction flag RUN is set to "0" in the initial state. As an operator pushes a reproduction switch, it change to "1", and as a stop switch is pushed, it again changes to "0".

If the reproduction flag RUN is "0", it means no reproduction instruction so that the process before the interrupt process is again executed without performing the reproduction process. If the reproduction flag RUN is "1", the flow advances to step SB2 to perform the reproduction process.

At step SB2, K is subtracted from a value of a register TIME. When the operator pushes the reproduction switch, the time data of the first performance event data is stored in the register TIME in the initial state. This time data indicates a time when sounds are first generated after the reproduction switch is pushed. The value K is determined in accordance with a performance tempo and an interrupt interval as in the following.

$$K=(\text{performance tempo}\times\text{resolution}\times\text{interrupt interval})/(60\times1000)$$

The resolution is a resolution of a quarter note, for example, 96. The larger the value K, the more the performance data per unit time is read for generating sounds.

For example, assuming that the performance tempo is 120 and the interrupt interval is 10 ms, $$K=(120\times96\times10)/(60\times1000)=1.92.$$

The time data is indicated by using a minimum unit of the resolution of a quarter note (e.g., 96).

At step SB3 it is checked whether or not a register TIME is "0" or smaller. If not, the performance data is not processed to terminate the process and return to the process before the interrupt process.

As the interrupt process is repeated at each 10 ms, the register TIME at step SB2 is gradually reduced. If it is judged at step SB3 that the register TIME is "0" or smaller, the flow advances to step SB4.

At step SB4, an address of the performance event area of RAM is incremented to read the data of either the time data or performance event data.

At step SB5, it is checked whether or not the read data is time data. If not, the read data is performance event data, and the flow advances to step SB7.

At step SB7, the performance event data is supplied to the tone generator 15 and the flow returns to step SB4 to repeat the above process for the next data. When the tone generator 15 is supplied with the performance event data, it generates a musical tone signal which is supplied via the D/A converter 16 to the sound system 17 to generate sounds.

If it is judged at step SB5 that the read data is time data, the flow advances to step SB6 whereat the read time data is added to the register TIME.

At step SB8 it is checked whether or not the register TIME is larger than "0". If not, i.e., if the register TIME is negative even if the time data is added to the register TIME at step SB6 because the register TIME took a negative value due to substraction of K at step SB2, then the flow returns to step SB4 to repeat the above process of the next data.

If it is judged at step SB8 that the register TIME is larger than "0", the interrupt process is terminated to return to the process before the interrupt process.

Figure 11:
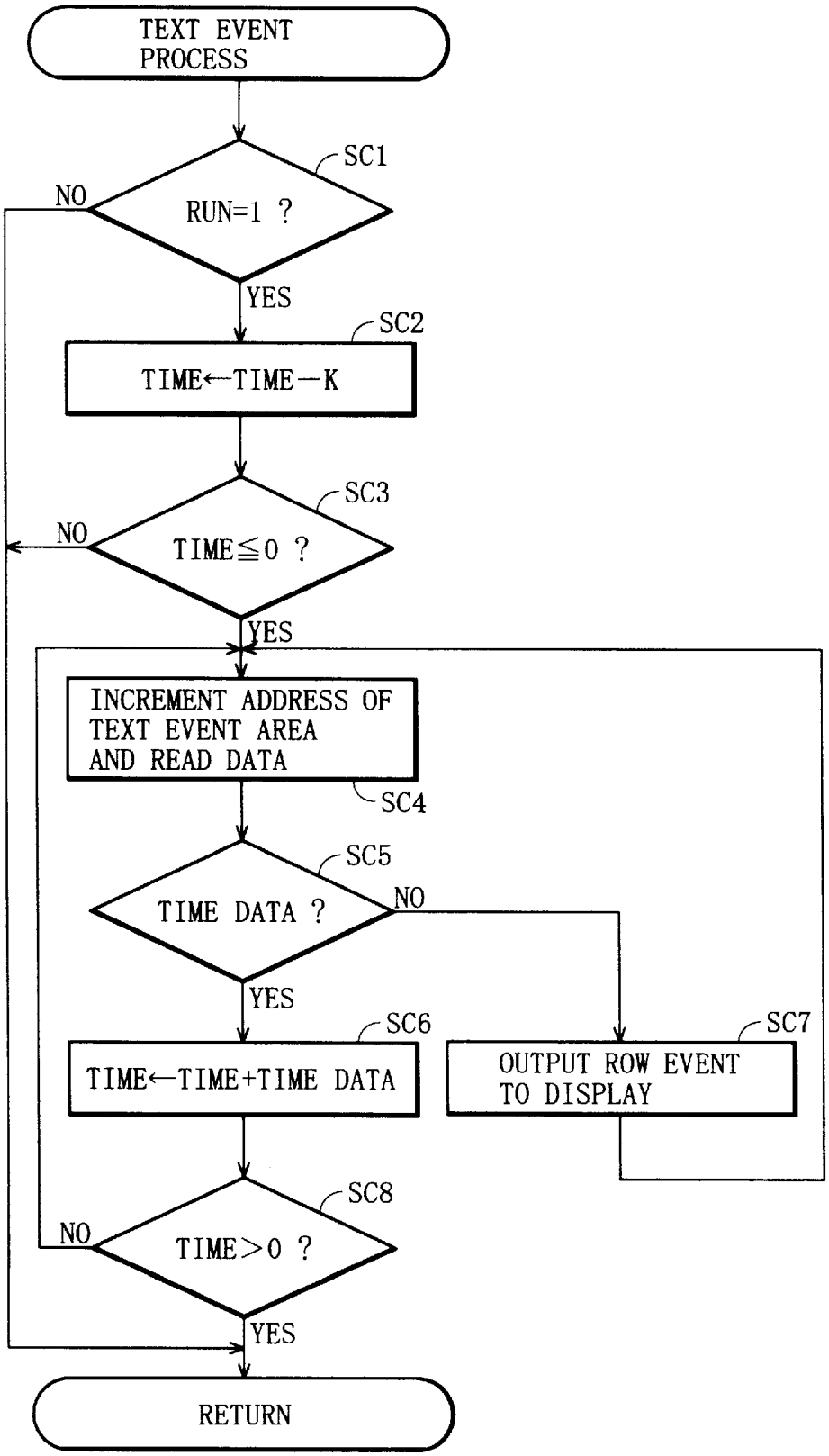
FIG. 11 is a flow chart illustrating a text event process.

FIG. 11 is a flow chart illustrating the text event process which is an interrupt process with an interrupt interval of, for example, 20 ms. If the performance event process is not necessary to be performed frequently, the interrupt interval may be made longer than that of the performance event process. The same interrupt interval may be set for both the performance and text event processes.

At step SC1 it is checked whether or not the reproduction flag RUN is "1". If the reproduction flag RUN is "0", it means no reproduction instruction so that the process before the interrupt process is again executed without performing the reproduction process. If the reproduction flag RUN is "1", the flow advances to step SC2 to perform the reproduction process.

At step SC2, K is subtracted from a value of the register TIME. As described above, the value K is determined in accordance with the performance tempo and interrupt interval.

At step SC3 it is checked whether or not the register TIME is "0" or smaller. If not, the text data is not processed to terminate the process and return to the process before the interrupt process. If it is judged that the register TIME is "0" or smaller, the flow advances to step SC4.

At step SC4, an address of the text event area of RAM is incremented to read the data of either the time data or row event data.

At step SC5, it is checked whether or not the read data is time data. If not, the read data is row event data, and the flow advances to step SC7.

At step SC7, the row event data is supplied to the display 14 and the flow returns to step SC4 to repeat the above process for the next data.

If it is judged at step SC5 that the read data is time data, the flow advances to step SC6 whereat the read time data is added to the register TIME.

At step SC8 it is checked whether or not the register TIME is larger than "0". If not, the flow returns to step SC4 to repeat the above process for the next data. If it is judged that the register TIME is larger than "0", the interrupt process is terminated to return to the process before the interrupt process.

Another embodiment will be described wherein auxiliary data is used in addition to the performance data and text data. The auxiliary data includes date of public presentation of music data, production country name, program genre, program meter, program beat, main musical instrument types for melody, singer gender, program composer, program text author, program arranger, player/singer name or player group/singer group name, music data generator, and the like.

The program genre indicates the type of music, such as rock, pop, jazz, and Latin. The meter indicates the number of beats in each bar, typically such as triple time and quadruple time. The beat indicates the number of strokes in each bar, and in the case of a program of quadruple time music, four beats, eight beats, and sixteen beats are generally used. Shuffle and swing are kinds of the beat. The main musical instrument types for melody indicate tone colors of musical instruments which perform melody parts. The singer gender indicate male solo, female solo, male and female duet, males, females, or no song.

The auxiliary data is supplied to the display 14 and is used for providing an operator with various information of performance data or for an operator to designate search conditions for searching performance data matching the search conditions. Three examples of the format of the auxiliary data are shown in FIGS. 12A to 14C.

Figure 12A:
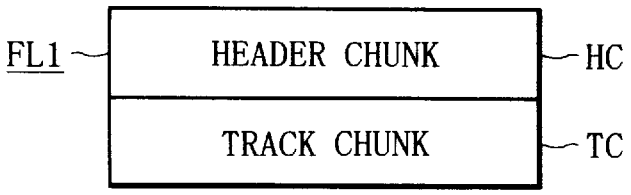
FIGS. 12A and 12B show a first data format including auxiliary data.
Figure 12B:
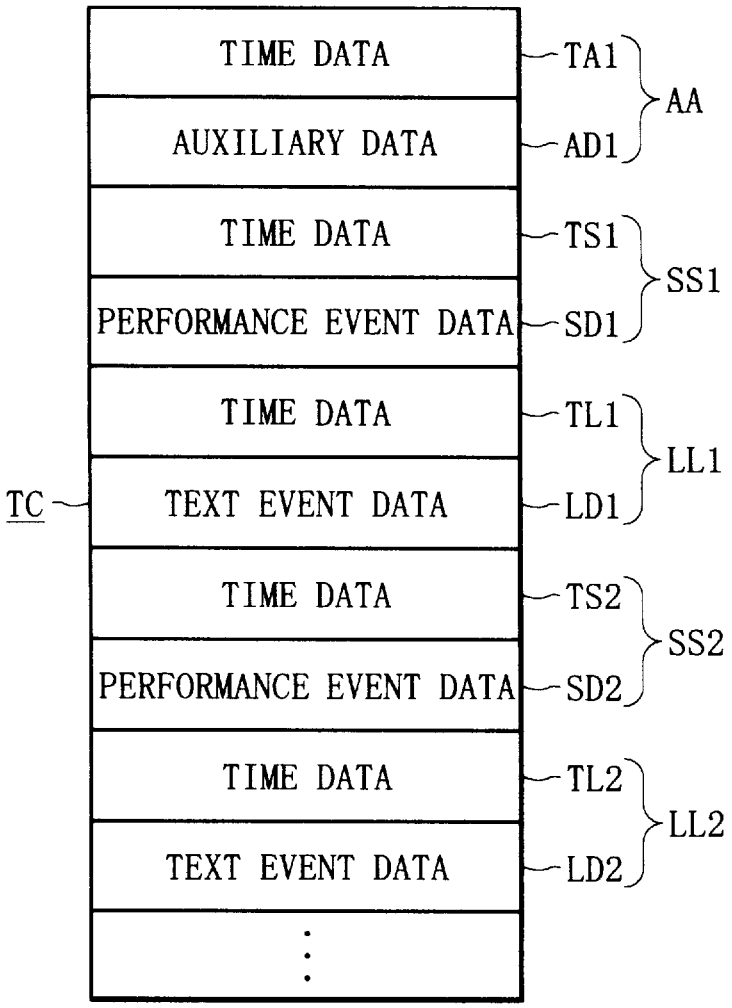

FIGS. 12A and 12B show a first data format.

FIG. 12A shows the format of a sequence file FL1. One set of music data is represented by one sequence file FL1. The sequence file FL1 is stored in HDD 22 or the like. The sequence file FL1 has a header chunk HC and a trunk chunk TC. The header chunk HC contains information (identification code of first, second, or third data format) and information of time resolution of data. The structure of the track chunk TC will be described.

FIG. 12B shows the data structure of the track chunk TC. The track chunk TC has a plurality set of data (auxiliary data AA, performance data SS1, text data LL1, . . .).

The auxiliary data AA has time data TA1 and auxiliary data AD1. The time data TA1 indicates a time duration from the start of performance data to the auxiliary data AD1, and generally stores a time "0". In other words, the auxiliary data AD1 is generated at the same time when the music performance starts. The auxiliary data AD1 is stored in a meta-event form containing of a large amount of auxiliary data described above.

The performance data SS1, SS2, text data LL1, LL2 have the same structure as described with FIG. 3B, and so the description thereof is omitted.

Figure 13A:
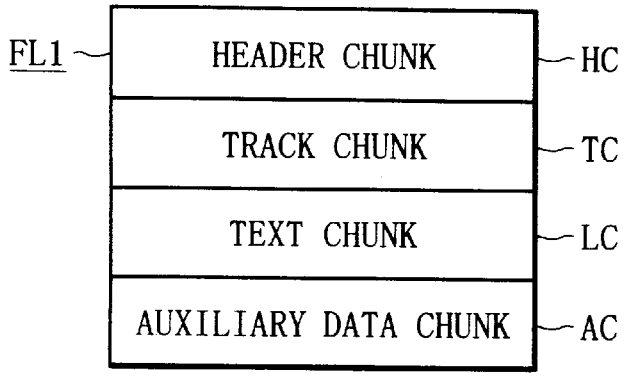
FIGS. 13A to 13C show a second data format including auxiliary data.
Figure 13B:
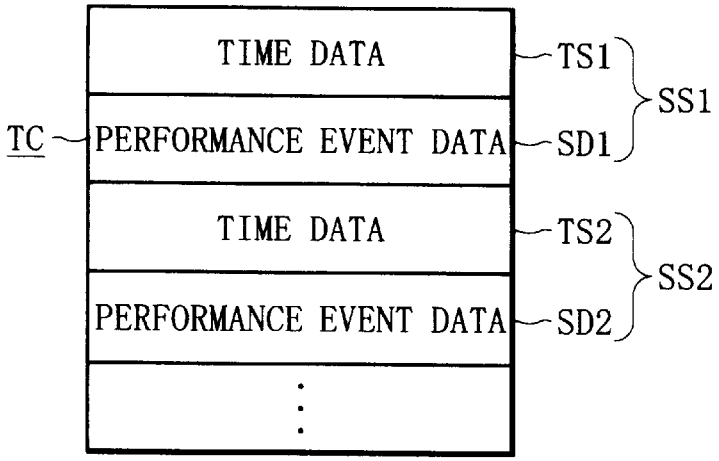
Figure 13C:
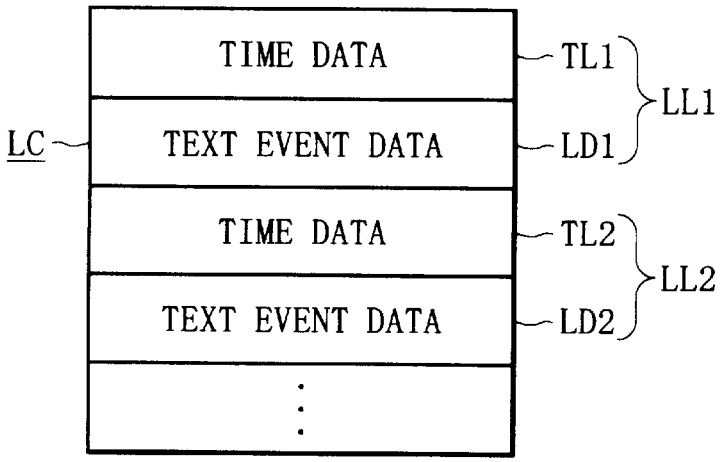

FIGS. 13A to 13C show a second data format. One set of music data is represented by one sequence file FL1. The sequence file FL1 has a header chunk HC, a trunk chunk TC, a text chunk LC, and an auxiliary data chunk AC. The header chunk HC has the same structure as the header chunk of the first data format (FIG. 12A). The structures of the track chunk TC and text chunk LC shown in FIGS. 13B and 13C are the same as those described with FIGS. 4A to 4C, and so the description thereof is omitted.

The auxiliary data chunk AC has the same structure as the auxiliary data AA1 shown in FIG. 12B. In other words, the contents of the auxiliary data AA1 are independently stored as one chunk.

Figure 14A:
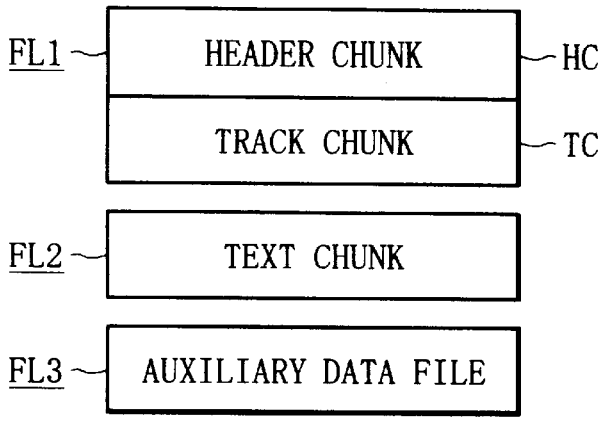
FIGS. 14A to 14C show a third data format including auxiliary data.
Figure 14B:
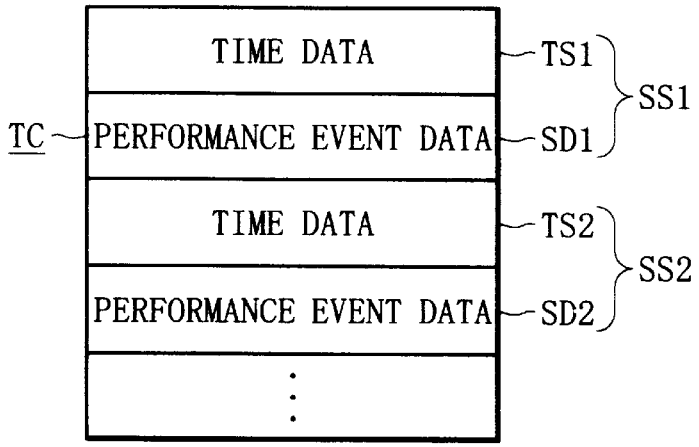
Figure 14C:
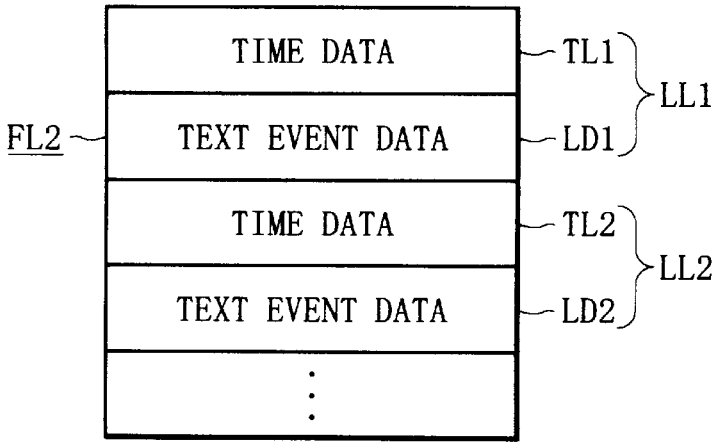

FIGS. 14A to 14C show a third data format.

FIG. 14A shows the formats of the sequence file FL1, text file FL2, and auxiliary file FL3. One set of music data is represented by one sequence file FL1, one text file FL2, and one auxiliary file FL3, and stored in HDD 22 or the like.

The structures of the sequence file FL1 and text file FL2 are the same as those described with FIGS. 5A to 5C. The auxiliary data file FL3 is a file newly generated to add auxiliary data to the sequence file FL1 and text file FL2. The auxiliary data file FL3 stores therein the same contents as the auxiliary data chunk AC described with FIG. 13A.

Figure 15:
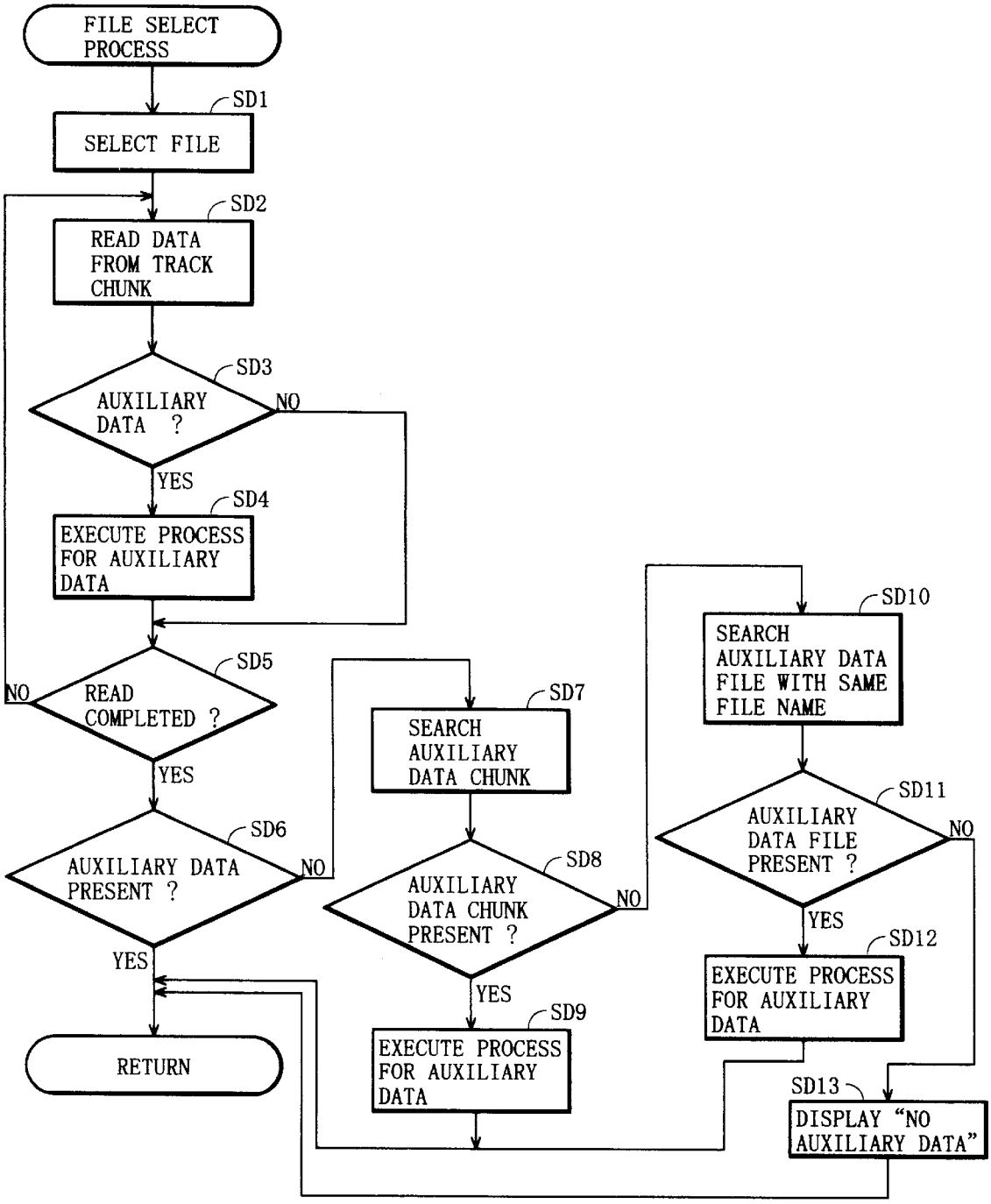
FIG. 15 is a flow chart illustrating a file selection process used when auxiliary data is processed.

FIG. 15 is a flow chart illustrating the file selection process to be executed by CPU.

At step SD1, a file is designated. Sequence file names of music data stored in HDD 22 or the like are displayed on the display 14. An operator selects a desired file by using the input device 13 such as a keyboard and a mouse. The format of the file selected by the operator may be any one of the first to third data formats.

At step SD2, data of the track chunk of the selected file is read. An identification code representative of a start of the track chunk is contained in the file. The position of the track chunk can be identified by this identification code.

Data read from the track chunk is one of text event data, performance event data, and auxiliary data. At step SD3, it is checked whether the read data is auxiliary data. If auxiliary data, the flow advances to step SD4 whereat a process depending upon the type of auxiliary data is executed. For example, the auxiliary data is supplied to the display 14 to display various information of performance data, or the auxiliary data is written in a predetermined register to prepare for a search process to be later executed, the search process searching performance data matching the search conditions including at least one set of auxiliary data.

If the read data is performance data or text data, the flow skips to step SDS whereat it is checked whether or not all data has been read from the track chunk. If not, the flow returns to step SD2 to repeat the same process as above for the next data in the track chunk. If all data has been read, the flow advances to step SD6.

It is checked at step SD6 whether or not the data read from the track chunk contains auxiliary data. If contained, it means the first data format (FIGS. 12A and 12B) and the file selection process is terminated.

If it is judged at step SD6 that the data read from the track chunk does not contain auxiliary data, it means either the second or third data format (FIGS. 13A to 13C, FIGS. 14A to 14C) and the flow advances to step SD7 to execute a different process for auxiliary data.

At step SD7, an auxiliary data chunk is searched from the selected sequence file. If it is the second data format, an identification code representative of a start of the auxiliary data chunk is contained in the file. The position of the auxiliary data chunk can be identified by this identification code.

At step SD8 it is checked whether or not the auxiliary data chunk has been found. If found, it means the second data format, and the flow advances to step SD9 whereat a process for the auxiliary data is performed similar to step SD4.

If it is judged at step SD8 that no auxiliary data chunk has been found, it means the third data format (FIGS. 14A to 14C), and the flow advances to step SD10.

At step SD10, an auxiliary data file having the same file name as the selected sequence file is searched. The third data format has a sequence file FL1 and a auxiliary data file FL3 separately stored, as shown in FIGS. 14A to 14C.

For example, a sequence file has a file name "ABCD-.MID" and an auxiliary data file has a file name "ABC-D.ASS". A file name has a main part such as ABCD and an extension part such as MID or ASS. These two files have the same main part of the file name "ABCD" and different extension parts "MID" and "ASS" of the file names. The extension "MID" indicates a sequence file, and "ASS" indicates an auxiliary data file.

Assuming that the sequence file "ABCD.MID" was selected, an auxiliary data file "ABCD.ASS" having the same main part of the file name is searched.

At step SD11 it is checked whether or not an auxiliary data file has been found. If found, the flow advances to step SD12.

At step SD12, the process depending upon the type of auxiliary data in the found auxiliary data file is executed similar to step SD4.

If it is judged at step SD11 that no auxiliary data file has been found, the flow advances to step SD13. At step SD13 a message "No auxiliary data" is displayed on the display 14 to terminate the process.

With the above process, auxiliary data of the first to third data formats are read and each process depending on the type of auxiliary data is executed.

In the above embodiments, a priority order is set higher in the order from the first, second, and third data formats to use text data or auxiliary data of the first data format most preferentially. The priority order may be changed. For example, if the highest priority order is given to the third data format, the text data or auxiliary data can be updated by preparing the new text data file or new auxiliary data file.

The auxiliary data is not limited to only to those described above, but any other type of data may be used which supplements performance data. For example, the auxiliary data of this embodiment may include data which adds voices such as songs and back chorus to performance data and data which adds additional accompaniment sounds (e.g., accompaniment pattern data) to performance data.

As above, even if music data of different formats as illustratively shown is supplied, it can be converted into data of the standard format for reproduction. Performance data generated by using various application software can therefore be reproduced.

Performance data without text data can be provided easily with text data. For example, automatic performance data of electronic musical instruments can by used with a karaoke sing-along machine by adding a text file as in the case of the third data format.

Even if music data of different formats is supplied, auxiliary data can be reliably used.

Performance data without auxiliary data can be provided easily with auxiliary data. By adding auxiliary data to performance data, the performance data can be easily searched and various information of the performance data can be given to an operator.

Since music data is separated into performance data and text data and stored in different areas, the processes for performance data and text data can be independently controlled. If the process for performance data is given a higher priority order, a delay in processing performance data can be avoided even if a load of the text data process is large.

A row event data up to the return symbol is stored in the text event area and displayed collectively. Instead, the row event data may be displayed in the unit of character or word.

The text data may be pre-read to display it before the performance data is reproduced. In this case, the performance position of the corresponding text data may be displayed in different color or with an underline.

In changing a reproduction tempo, the period of tempo clocks may be changed, the value of time data may be modified without changing the tempo clock, or a value counted by one process may be changed.

Not only the performance data and text data, video data may be processed. In this case, the image data may be processed independently or may be processed when the text data is processed if the video data of still images is used.

The embodiments can be applied to communications with karaoke sing-along machines or personal computers, either at the receiving side or transmitting side.

The data formats described above are only illustrative. The format of performance data may be a combination of an event and a relative time, a combination of an event and an absolute time, a combination of a pitch and a note length, or a direct record scheme (presence/absence of an event is recorded for each unit time duration).

The data format may contain each channel in a separate truck or a plurality of channels in one track.

The present invention has been described in connection with the preferred embodiments. The invention is not limited only to the above embodiments. It is apparent to those skilled in the art that various modifications, improvements, combinations and the like can be made without departing from the scope of the appended claims.

We claim:

1. A music data processing system comprising:

input means for externally inputting data having a format containing both performance data and text data in a mixed state;

a memory having a performance data storage area for storing the performance data and a text data storage area for storing the text data;

writing means for writing the data input from said inputting means separately into the performance data storage area and into the text data storage area;

text data reproducing means for reading and reproducing the text data stored in the text data storage area; and performance data reproducing means for reading and reproducing the performance data stored in the performance data storage area, wherein reproduction of said performance data has a priority over reproduction of said text data.

2. A music data processing system comprising:

storage means for storing performance data with a file name identifying the performance data and storing text data corresponding to the performance data with a file name relatable to the file name of the performance data;

designating means for designating a file name of the performance data to be reproduced;

performance data reproducing means for reading performance data having the file name designated by said designating means and reproducing the performance data;

search means for searching text data with a file name relatable to the file name of the performance data designated by said designating means; and text data reproducing means for reading the searched text data having the file name relatable to the file name designated by said designating means.

3. A music data processing system according to claim 2, wherein said storage means stores performance data with a file name and text data with a file name, each of the file names has a main part and an extension part which identifies the performance data or the text data, said designating means designates a main part of a file name, said performance data producting means reads performance data with a file name which has the main part designated by said designating means and reproduces the performance data, and said search means searches text data with a file name which has the main part designated by said designating means and the extension part identifying the text data.

4. A music data processing system comprising:

storage means for storing performance data and text data in a first storage format or in a second storage format;

first text data search means for searching the text data stored in the first storage format;

second text data search means for searching the text data stored in the second storage format; and reproducing means for reproducing text data and performance data if the text data of the first storage format can be searched by said first text data search means, and if the text data of the first storage format cannot be searched, reproducing text data and performance data if the text data of the second storage format can be searched by said second text data search means.

5. A music data processing system according to claim 4, wherein said first and second storage formats are each a combination of two formats selected from a group consisting of a storage format storing both performance data and text data in the same file in a mixed state, a storage format storing performance data and text data separately in the same file, and a storage format storing performance data and text data separately in different files.

6. A music data processing system comprising:

storage means for storing performance data with a file name identifying the performance data and storing auxiliary data corresponding to the performance data with a file name relatable to the file name of the performance data;

designating means for designating a file name of the performance data to be reproduced;

performance data reproducing means for reading performance data having the file name designated by said designating means and reproducing the performance data;

search means for searching auxiliary data with a file name relatable to the file name of the performance data designated by said designating means; and auxiliary data processing means for reading the searched auxiliary data having the file name relatable to the file name designated by said designating means.

7. A music data processing system according to claim 6, wherein said storage means stores performance data with a file name and auxiliary data with a file name, each of the file names has a main part and an extension part which identifies the performance data or the auxiliary data, said designating means designates a main part of a file name, said performance data producting means reads performance data with a file name which has the main part designated by said designating means and reproduces the performance data, and said search means searches auxiliary data with a file name which has the main part designated by said designating means and the extension part identifying the text data.

8. A music data processing system comprising:

storage means for storing performance data and auxiliary data in a first storage format or in a second storage format;

first auxiliary data search means for searching the auxiliary data stored in the first storage format;

second auxiliary data search means for searching the auxiliary data stored in the second storage format; and auxiliary data processing means for processing auxiliary data if the auxiliary data of the first storage format can be searched by said first auxiliary data search means, and if the auxiliary data of the first storage format cannot be searched, processing auxiliary data if the auxiliary data of the second storage format can be searched by said second auxiliary data search means.

9. A music data processing system accord ing to claim 8, wherein said first and second storage formats are each a combination of two formats selected from a group consisting of a storage format storing both performance data and auxiliary data in the same file in a mixed state, a storage format storing performance data and auxiliary data separately in the same file, and a storage format storing performance data and auxiliary data separately in different files.

10. A method of processing music data comprising the steps of:

inputting data having a format containing both performance data and text data in a mixed state;

separating the input data into performance data and text data;

recording the separated performance data and text data into different areas; and reading and reproducing the recorded text data and the recorded performance data, wherein reproduction of said performance data has a priority over reproduction of said text data.

11. A method of processing music data comprising the steps of:

designating a file name of performance data to be reproduced;

searching a file name of text data corresponding to the performance data, the file name of the text data being relatable to the file name of the performance data; and reading the performance data with the designated file name from storage means and reproducing the read performance data, and reading the text data having the searched file name from the storage means and reproducing the read text data.

12. A method of processing music data according to claim 11, wherein said file name has a main part and an extension part which identifies a performance data or a text data, the step of designating a file name of performance data includes the step of designating a main part of a file name, and the step of searching an attribute name of text data includes the step of searching text data with a file name which has the designated main part and the extension part identifying the text data.

13. A method of processing music data comprising:

searching, from storage means storing performance data and text data in a first storage format or in a second storage format, text data of the first storage format;

processing the searched text data of the first storage format to reproduce the searched text data and corresponding performance data;

searching, if the text data of the first storage format cannot be searched, text data of the second storage format from the storage means storing performance data and text data in the first or second storage format; and processing the searched text data of the second storage format to reproduce the searched text data and corresponding performance data.

14. A method of processing music data according to claim 13, wherein said first and second storage formats are each a combination of two formats selected from a group consisting of a storage format storing both performance data and text data in the same file in a mixed state, a storage format storing performance data and text data separately in the same file, and a storage format storing performance data and text data separately in different files.

15. A method of processing music data comprising the steps of:

designating a file name of performance data to be reproduced;

searching a file of performance data and a file of auxiliary data identified by a file name relatable to the file name of the performance data, by using the designated file name of the performance data as a search key; and reading the performance data and auxiliary data from the searched two files to reproduce the performance data and process the auxiliary data.

16. A method of processing music data according to claim 15, wherein said file name has a main part and an extension part which identifies a performance data or an auxiliary data, the step of designating a file name of performance data includes the step of designating a main part of a file name, and the step of searching a file of performance data and a file of auxiliary data includes the step of searching a file of performance data and a file of auxiliary data identified by the designated main part.

17. A method of processing music data comprising:

searching, from storage means storing performance data and auxiliary data in a first storage format or in a second storage format, auxiliary data of the first storage format;

processing the searched auxiliary data of the first storage format;

searching, if the auxiliary data of the first storage format cannot be searched, auxiliary data of the second storage format from the storage means storing performance data and auxiliary data in the first or second storage format; and processing the searched auxiliary data of the second storage format.

18. A method of processing music data according to claim 17, wherein said first and second storage formats are each a combination of two formats selected from a group consisting of a storage format storing both performance data and text data in the same file in a mixed state, a storage format storing performance data and text data separately in the same file, and a storage format storing performance data and text data separately in different files.

19. A machine readable medium containing instructions for causing the machine to perform a method of processing music data, the method comprising the steps of:

inputting data having a format containing both performance data and text data in a mixed state;

separating the input data into performance data and text data;

recording the separated performance data and text data into different areas; and reading and reproducing the recorded text data and the recorded performance data, wherein reproduction of said performance data has a priority over reproduction of said text data.

20. A machine readable medium containing instructions for causing the machine to perform a method of processing music data, the method comprising the steps of:

designating a file name of performance data to be reproduced;

searching a file name of text data corresponding to the performance data, the file name of the text data being relatable to the file name of the performance data; and reading the performance data with the designated file name from storage means and reproducing the read performance data; and reading the text data having the searched file name from the storage means and reproducing the read text data.

21. A machine readable medium according to claim 20, wherein said file name has a main part and an extension part which identifies a performance data or a text data, the step of designating a file name of performance data includes the step of designating a main part of a file name, and the step of searching an attribute name of text data includes the step of searching text data with a file name which has the designated main part and the extension part identifying the text data.

22. A machine readable medium containing instructions for causing the machine to perform a method of processing music data, the method comprising the steps of:

searching, from storage means storing performance data and text data in a first storage format or in a second storage format, text data of the first storage format;

processing the searched text data of the first storage format to reproduce the searched text data and corresponding performance data;

searching, if the text data of the first storage format cannot be searched, text data of the second storage format from the storage means storing performance data and text data in the first or second storage format; and processing the searched text data of the second storage format to reproduce the searched text data and corresponding performance data.

23. A machine readable medium according to claim 22, wherein said first and second storage formats are each a combination of two formats selected from a group consisting of a storage format storing both performance data and text data in the same file in a mixed state, a storage format storing performance data and text data separately in the same file, and a storage format storing performance data and text data separately in different files.

24. A machine readable medium containing instructions for causing the machine to perform a method of processing music data, the method comprising the steps of:

designating a file name of performance data to be reproduced;

searching a file of performance data and a file of auxiliary data identified by a file name relatable to the file name of the performance data, by using the designated file name of the performance data as a search key; and reading the performance data and auxiliary data from the searched two files to reproduce the performance data and process the auxiliary data.

25. A machine readable medium according to claim 24, wherein said file name has a main part and an extension part which identifies a performance data or an auxiliary data, the step of designating a file name of performance data includes the step of designating a main part of a file name, and the step of searching a file of performance data and a file of auxiliary data includes the step of searching a file of performance data and a file of auxiliary data identified by the designated main part.

26. A machine readable medium containing instructions for causing the machine to perform a method of processing music data, the method comprising the steps of:

searching, from storage means storing performance data and auxiliary data in a first storage format or in a second storage format, auxiliary data of the first storage format;

processing the searched auxiliary data of the first storage format;

searching, if the auxiliary data of the first storage format cannot be searched, auxiliary data of the second storage format from the storage means storing performance data and auxiliary data in the first or second storage format; and processing the searched auxiliary data of the second storage format.

27. A method of processing music data according to claim 26, wherein said first and second storage formats are each a combination of two formats selected from a group consisting of a storage format storing both performance data and text data in the same file in a mixed state, a storage format storing performance data and text data separately in the same file, and a storage format storing performance data and text data separately in different files.

* * * * *